US009067256B2

(12) United States Patent
Anagnostopoulos

(10) Patent No.: US 9,067,256 B2
(45) Date of Patent: Jun. 30, 2015

(54) SYSTEMS AND PROCESSES FOR THE PRODUCTION OF METALLIC FRAMES

(76) Inventor: Antonios Anagnostopoulos, Attikis (GR)

( * ) Notice: Subject to any disclaimer, the term of this patent is extended or adjusted under 35 U.S.C. 154(b) by 285 days.

(21) Appl. No.: 13/823,712

(22) PCT Filed: Jun. 20, 2012

(86) PCT No.: PCT/IB2012/053103
§ 371 (c)(1),
(2), (4) Date: Mar. 14, 2013

(87) PCT Pub. No.: WO2012/176128
PCT Pub. Date: Dec. 27, 2012

(65) Prior Publication Data

US 2013/0186508 A1 Jul. 25, 2013

Related U.S. Application Data

(60) Provisional application No. 61/499,765, filed on Jun. 22, 2011.

(30) Foreign Application Priority Data

Jun. 23, 2011 (GR) ..... 20110100374

(51) Int. Cl.
*B21F 1/00* (2006.01)
*B21F 15/06* (2006.01)
(Continued)

(52) U.S. Cl.
CPC . *B21F 1/00* (2013.01); *B21F 15/06* (2013.01); *B21F 15/08* (2013.01); *B21F 37/00* (2013.01)

(58) Field of Classification Search
CPC ..... B21F 11/00; B21F 15/02; B21F 15/06; B21F 15/08; B21F 23/005; B21F 27/16; B21F 37/00
USPC ..... 72/129, 131, 294, 306, 307; 29/91.1; 140/1, 88, 93.2, 93.4, 93 D, 11, 24, 51, 140/111, 112
See application file for complete search history.

(56) References Cited

U.S. PATENT DOCUMENTS 1,457,691 A 6/1923 Bull
2,004,409 A * 6/1935 Hopkins ..... 140/112
(Continued)

FOREIGN PATENT DOCUMENTS

EP 0032656 B1 12/1984
GB 1194719 A * 6/1970 ..... B21F 37/00
(Continued)

OTHER PUBLICATIONS

Search report of the Greek (GR) National Patent Office in priority application GR20110100374, report dated Nov. 9, 2012; discussed in Applicant's transmittal letter.
(Continued)

*Primary Examiner* — Edward Tolan
(74) *Attorney, Agent, or Firm* — George Kapsalas; Patentbuero Paul Rosenich AG

(57) ABSTRACT

Systems and methods for producing metallic frames from wire or strip or other material of prismatic cross section, which material may subjected to plastic bending, and the ends of which are joined together. The production process for metallic frames occurs in three phases, in three separate positions, which may function independently of one another. In the first position the wire or strip (1) may be pulled from a spool, be straightened (2), then measured (4) in length and cut. At the second position the beginning and end of wire material (1) are there transferred, and there the ends are joined. In the third phase the frame is transferred, with its ends joined, and the measurements and bendings of the sides are made, so as to produce a desired product configuration at the third position.

20 Claims, 5 Drawing Sheets

(51) Int. Cl.

| | |
|---|---|
| ***B21F 15/08*** | (2006.01) |
| ***B21F 37/00*** | (2006.01) |

(56) References Cited

U.S. PATENT DOCUMENTS

| | | | | | |
|---|---|---|---|---|---|
| 2,976,611 | A | | 3/1961 | Giffen | |
| 3,976,385 | A | | 8/1976 | Klopfer | |
| 4,280,350 | A | | 7/1981 | King et al. | |
| 4,365,492 | A | * | 12/1982 | Kortan et al. | 72/11.1 |
| 4,688,953 | A | | 8/1987 | Koch et al. | |
| 4,823,576 | A | | 4/1989 | Yoshioka | |
| 5,020,575 | A | * | 6/1991 | Grabuschnig et al. | 140/112 |
| 5,054,178 | A | * | 10/1991 | Zuger | 29/91.1 |
| 5,136,867 | A | | 8/1992 | Zuger | |
| 5,672,283 | A | * | 9/1997 | Wall | 219/56 |
| 6,460,235 | B1 | * | 10/2002 | Del Fabro et al. | 29/33 F |
| 7,043,951 | B2 | * | 5/2006 | Suzuki et al. | 72/129 |
| 2001/0032359 | A1 | | 10/2001 | Anagnostopoulos | |
| 2002/0020048 | A1 | | 2/2002 | Anagnostopoulos | |
| 2006/0207677 | A1 | * | 9/2006 | Carr | 140/88 |
| 2009/0189007 | A1 | * | 7/2009 | Cooper et al. | 242/434.7 |

FOREIGN PATENT DOCUMENTS

| | | | |
|---|---|---|---|
| GR | 960100215 | A | 2/1998 |
| JP | S58-097451 | A | 6/1983 |
| JP | S61-242734 | A | 10/1986 |
| JP | H01-278931 | A | 11/1989 |
| WO | 00/64610 | A1 | 11/2000 |
| WO | 00/67933 | A1 | 11/2000 |

OTHER PUBLICATIONS

PCT Search Report and PCT written report on patentability mailed Nov. 19, 2012 from parent PCT application No. PCT/IB2012/053103. In English.

* cited by examiner

SYSTEMS AND PROCESSES FOR THE PRODUCTION OF METALLIC FRAMES

This application is a 35 U.S.C. 371 national-phase entry of PCT International application no. PCT/IB2012/053103 filed on Jun. 20, 2012 and also claims benefit of priority to prior Greek national application no. GR-20110100374 filed on Jun. 23, 2011, and also claims priority as a non-provisional of U.S. provisional application Ser. No. 61/499,765 filed on Jun. 22, 2011, and both Greek national application no. GR-20110100374 and U.S. provisional application Ser. No. 61/499,765, as well as parent PCT International application no. PCT/IB2012/053103, are all incorporated herein by reference in their entireties and as to all their parts for all intents and purposes, as if identically set forth in full herein.

TECHNICAL FIELD

The present invention relates to systems and processes for producing metallic frames from wire, from strip, or from other material of prismatic cross section. This material may be subjected to plastic bending. Its ends are joined one with the other. In versions, they may be welded, or joined with a metallic clip, or both welded and joined with a metallic clip. Such frames may typically find application in mattress making, in chair making, as well as in other applications.

BACKGROUND ART

In the prior practices, the construction of metallic frames was usually effected with two machines. In the first of the two, the metallic frames are produced with steps of straightening of the wire and continuous advancements-bendings of the wire. Subsequent to this, the frame is transferred to the second of the two, being a welding or joining machine, where the two ends of the frame are welded or connected.

Alternative production methods were presented in Hellenic published application number GR-960100215A, and in its modification published as PCT International Application number WO00/67933A1 having family equivalent U.S. published application no. 2001/0032359A1. Likewise, alternative production methods were also presented in PCT International Application number WO00/64610A1 having family equivalent U.S. published application no. 2002/0020048A1. According to these references, the production of metallic frames for mattresses was effected at one machine with the specified phases of (1.) advancement, and straightening and measuring of the wire or strip to produce a circle or ellipsoid developed with the development of the frame, (2.) joining of the two ends with a clip or tube, and finally, (3.) a series of bendings at suitable locations to create the final frame.

SUMMARY OF INVENTION

Technical Problem

Considering the prior production methods utilizing two or more machines, such methods have the following disadvantages. They require two machines. They need, and thus occupy, a large space. The transfer of the frames between the machines is difficult due to the elasticity that the frames exhibit. Thus, such machines and processes exhibit diminished productivity.

Considering the alternative production methods exemplified in the above-mentioned patent publications, a significant disadvantage of these is that the phase of advancement and straightening of the wire or the strip, and the phase of joining of the two ends are effected in series or one after the other, and not simultaneously. The advancement of, or loading of material for a subsequent frame is delayed until the joining of the ends of the material of a presently-worked frame. This leads to diminished productivity of the machine.

Solution to the Problem

It is within the scope of the invention to provide systems and methods in which the three phases of frame production may be realized in parallel.

Thus, it may be understood as also within the scope of the invention to set forth:

Advantageous systems for the production of frames from material such as wire or strip or other material of prismatic cross section, comprising:

a feeding station configured to introduce material sections;

a joining station for joining together the ends of material sections introduced into the machine, so as to produce frame loops;

a bending station for controllably bending frame angles in frame loops produced by said joining station;

wherein said joining station is disposed at a first axially offset location Ph2 offset from the location Ph1 of said feeding station, said offset being in the direction of an axis of frame loops formed at said joining station; or alternatively stated, said joining station being disposed at a first axially spaced offset location Ph2 spaced from the location Ph1 of said feeding station, in the direction of an axis passing through said feeding, joining, and bending stations;

a material guide 5 extending between said feeding station and said joining station, said material guide having a channel;

a clamping mechanism configured to retain a first unjoined end of material section passed through said material guide;

a release mechanism or mechanisms configured to controllably release material from said channel or said material guide;

transfer mechanisms configured to transfer a second unjoined end of a material section from said feeding station to said joining station, and, to transfer a frame loop from said joining station to said bending station, said bending station being disposed at a second axially offset location Ph3 offset in the direction of an axis of frame loops formed at said joining station; or alternatively stated, transfer mechanisms configured to transfer a second unjoined end of a material section from said feeding station to said joining station, and, to transfer a frame loop from said joining station to said bending station, said bending station being disposed at a second axially spaced offset location Ph3 spaced from the first offset location Ph2 of said joining station, in the direction of an axis passing through said feeding, joining, and bending stations.

The scope of the invention may also be understood to encompass a system for the production of metallic frames from wire or strip having its ends joined, this system effecting the process for production of the metallic frames in three phases, at three distinct locations, where in the first location material is advanced sufficient for the extent of the frame. In the second location the union of the ends of material is made in a suitable connection mechanism. In the third phase, there is produced the desired shape with continuing advancements by a pair of advancement rollers with following bendings in a bending mechanism having bending rollers, with the transfer of material from the first location to the connection region occurring by a suitable gripper, and with the transfer of the connected material from the connection region Ph2 to the bending region occurring by a suitable mechanism and jaws.

Optionally, in systems according to the immediately preceding paragraph above, the advancement of material in the first phase may be made inside a guide which has the form of an angle with the wire in its interior. This angle is covered by plates that are pulled by the action of cylinders, energization of which pulls the plates and uncovers the interior of the guides, so that the advanced material is uncovered and freed and may continue in its advancement until the entire frame extent is advanced.

Optionally, in systems according to this same preceding paragraph above, the connection of the two ends may be made by resistance welding and clip-joining with strip, with the ends of the frame being initially captured in the electrodes of a gripper by the action of cylinders, with one jaw being seated on a bar. The action of a cylinder pushes one end of the wire onto the other, and the action of the welding transformer resistance welds the ends of the frame. In following, by the action of a clip mechanism there is wrapped on the frame material, in the region of the weld, a strip that is supplied from a mechanism and pulled from its supply.

Optionally, in systems according to this same preceding paragraph above, the transfer of the welded frame from the phase and region of connection to the bending mechanism is made by grippers that are located at the ends of frame that is seated on an axis and that is moved by a cylinder from the location of the connection mechanism to the bending mechanism.

Optionally, in systems according to this same preceding paragraph above, the form of the frame is produced in series of advancements from advancement rollers and bendings from a bender with rollers, so that there is produced the desired product.

Optionally, in systems according to this same preceding paragraph above, the system may controlled by an electronic computer and all its phases of production may be implemented automatically.

Further considering systems according to this same preceding paragraph above, the pulling and advancement of the wire or strip from a spool may be made with advancement rollers, the straightening with a straightener, the measurement of length with the measuring rollers, and the cutting of the material in cutter.

Furthermore, it may be understood as also within the scope of the invention to set forth:

Advantageous processes for the production of frames from material such as wire or strip or other material of prismatic cross section, comprising the steps of:

introducing a material section via a feeding station;

joining together the ends of a material section at a joining station to produce a frame loop;

bending frame angles in the produced frame loops at a bending station;

also including steps of, disposing the joining station at a first axially spaced offset location Ph2 spaced from the location Ph1 of said feeding station, in the direction of an axis passing through said feeding, joining, and bending stations;

guiding the material section between the feeding station and the joining station through a material guide;

clamping the material section when a first unjoined end of the material section is in the joining station;

releasing the material section from the material guide;

transferring a second unjoined end of the material section to the joining station;

disposing the bending station at a second axially spaced offset location Ph3 spaced from the first offset location Ph2 of said joining station, in the direction of an axis passing through said feeding, joining, and bending stations; and, transferring a frame loop having joined ends from said joining station to said bending station.

However, the scope of the invention may also be understood to encompass methods for the production of metallic frames, from wire or strip, with joining of their ends, wherein the procedure of production of the metallic frames is made in three phases, at three distinct positions which function independently relative to one another. In the first position the wire or strip may be pulled from the spool, it may be straightened, and there may be a measurement of its length and its cutting. In the second position there are transferred the beginning and the end of the wire. There, the joining of these ends is made. The frame with its ends connected is transferred in the third phase, and there the measurements and bendings of the sides are made so that the desired shape may be produced.

Optionally, methods according to the immediately preceding paragraph above include that the beginning of wire or strip, emerging from the straightener and its advancement mechanism, enters into a channel with circular path and is guided by it to a location at the end of the canal, where the beginning of the wire or strip is gripped and immobilized by a gripper, and in following the canal opens at its sides and permits the wire or strip which continues to supplement its length to exit from the channel until it attains the necessary length corresponding to the perimeter of the under-construction metallic frame, whereafter the advancement is terminated and the wire is cut. In following, the second end of the wire is transferred with a gripper to a gripper of the joining mechanism for ends, where the two ends of the material are united one to the other.

Optionally, methods according to this same preceding paragraph above include union of the two ends made initially by welding of the ends, and following by clip joining with a strip at the weld region, so that with the simultaneous welding and clip joining with strip, there is created a particularly durable connection of the ends.

Optionally, methods according to this same preceding paragraph above include the union of the two ends of the frame being made by welding the ends.

Optionally, methods according to this same preceding paragraph above include the union of the two ends of the frame being made by clip joining with a metal plate.

Optionally, methods according to this same preceding paragraph above include, in the first phase, the straightening and advancement of the wire effected by a rotating rotor that pulls, advances, and simultaneously straightens the wire.

Optionally, methods according to this same preceding paragraph above include, in the first phase, the straightening of the material effected by two-level straightening.

At this point, it is pointed out that, in the context of this disclosure, the term "wire" can equivalently be understood as meaning or indicating, in the context of the present disclosure claims and appended drawings, a wire, rod, or other suitable elongate material of cylindrical or other diverse (prismatic) cross-section; as in implementations of the invention the material employed, as well as the dimension of the individual elements, may be commensurate with the requirements of particular applications.

Advantageous configurations and further developments are evident from the description in combination with the figures of the drawings.

Advantageous Effects of Invention

The present processes as well as systems implementing them, permit increase of the productivity eliminating the intermediate dead times during operation. The processes present many advantages, especially notably in that frame production is realized in three phases simultaneously, in three different locations which are located close one to the others. The space occupied by the system thus is limited. The processes lead to the construction of systems having high productivity. Furthermore, the processes permit the production of frames from wire, or strip, or material of other prismatic cross section.

BRIEF DESCRIPTION OF THE DRAWINGS

Aspects of the systems and processes according to the present invention may be understood from the following description and from the attached drawings, where exemplary versions of the processes and systems are presented as follows.

DESCRIPTION OF EMBODIMENTS

Figure 1:
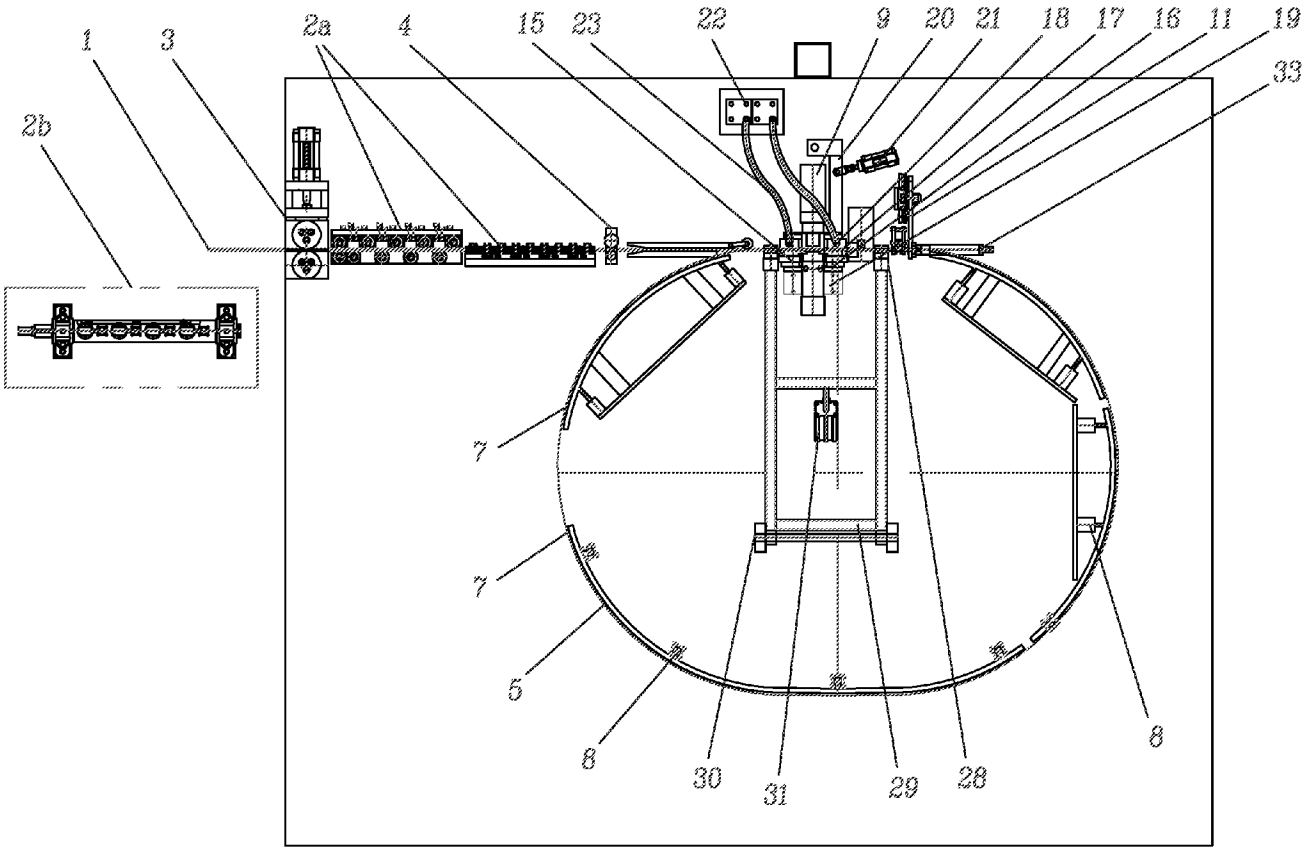
FIG. 1 depicts an example of a version of the invention for the production of metallic frames, in front view.

In following are presented description of implementation of the systems and processes in the sense of non-limiting examples.

Considering FIGS. 1-3, some exemplary processes for production of the frame, and some exemplary systems according to the present invention may be understood as follows: The material 1 may be advanced by the advancement rollers 3 through the straightening unit 2 towards the store 5, and the advanced length may be controlled from the measuring rollers 4. With the filling of the store 5, the end of the material ceases at the joining mechanism 9 where it is restrained by gripper 15. In following, the cap 7 of the guide 6 opens, the material hangs from the exit of the cutter 10 and its advancement continues supplementing to a length equal to the extent of the frame.

With the conclusion of the advancement, the material is cut by cutter 10, and the cut end is transferred from carrier 11 to the joining mechanism 9. The nature of the feeding station at phase/location Ph1 may be selected appropriate to the material 1 to be introduced into the guide. For example, in the case of prestraightened material, straightening mechanisms 2 may be entirely absent as unneeded, and only measurement 4 and the cutting mechanism 10 are needed. In the case of pre-cut (pre-measured) material sections, a cutter 10 and the measurement rollers 4 may be entirely absent, with only the straightening mechanisms 2 needed. Finally, in the case of prestraightened, pre-cut material 1 sections, the feeding station at Ph1 may comprise simply an inlet to guide 5, or an additional guide to the inlet to guide 5, as appropriate. In any of these cases, it is contemplated that this transfer of the end that is transferred from the feeding station at Ph1 to the joining mechanism 9 is realized by the carrier 11.

Figure 2:
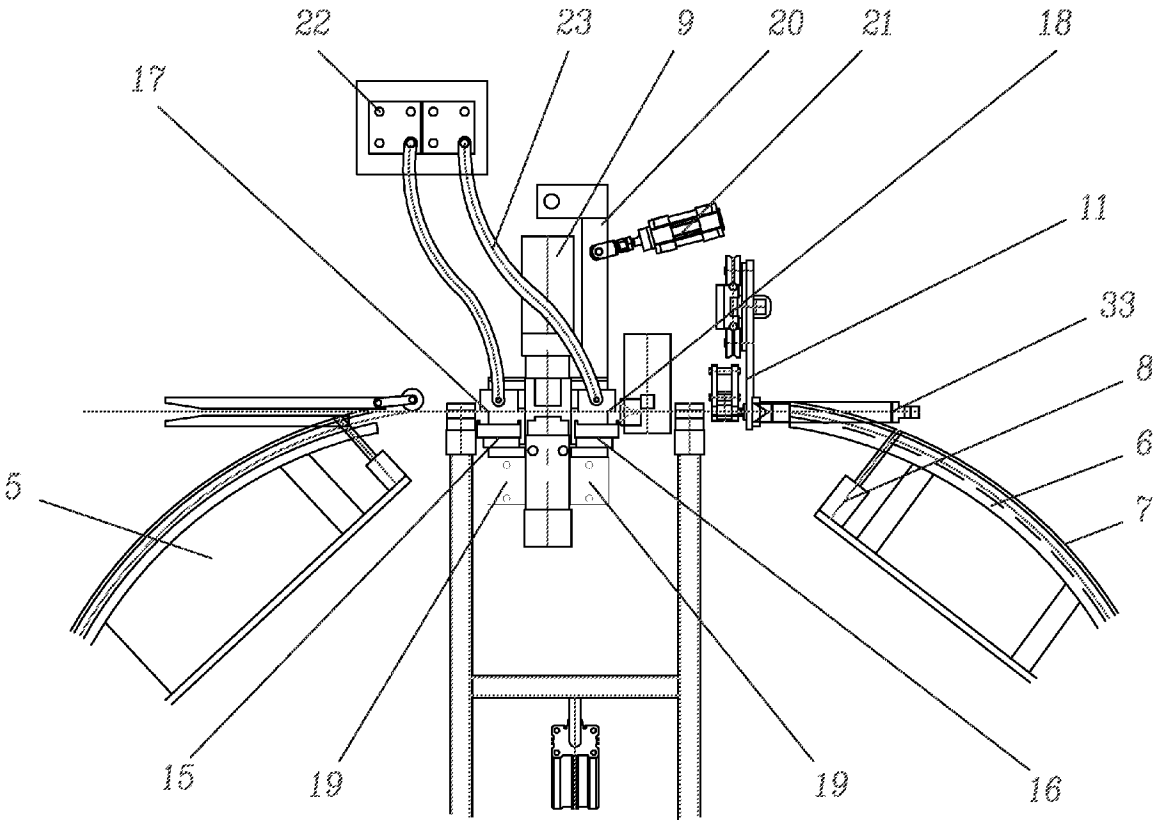
FIG. 2 depicts a joining mechanism in front view.
Figure 3:
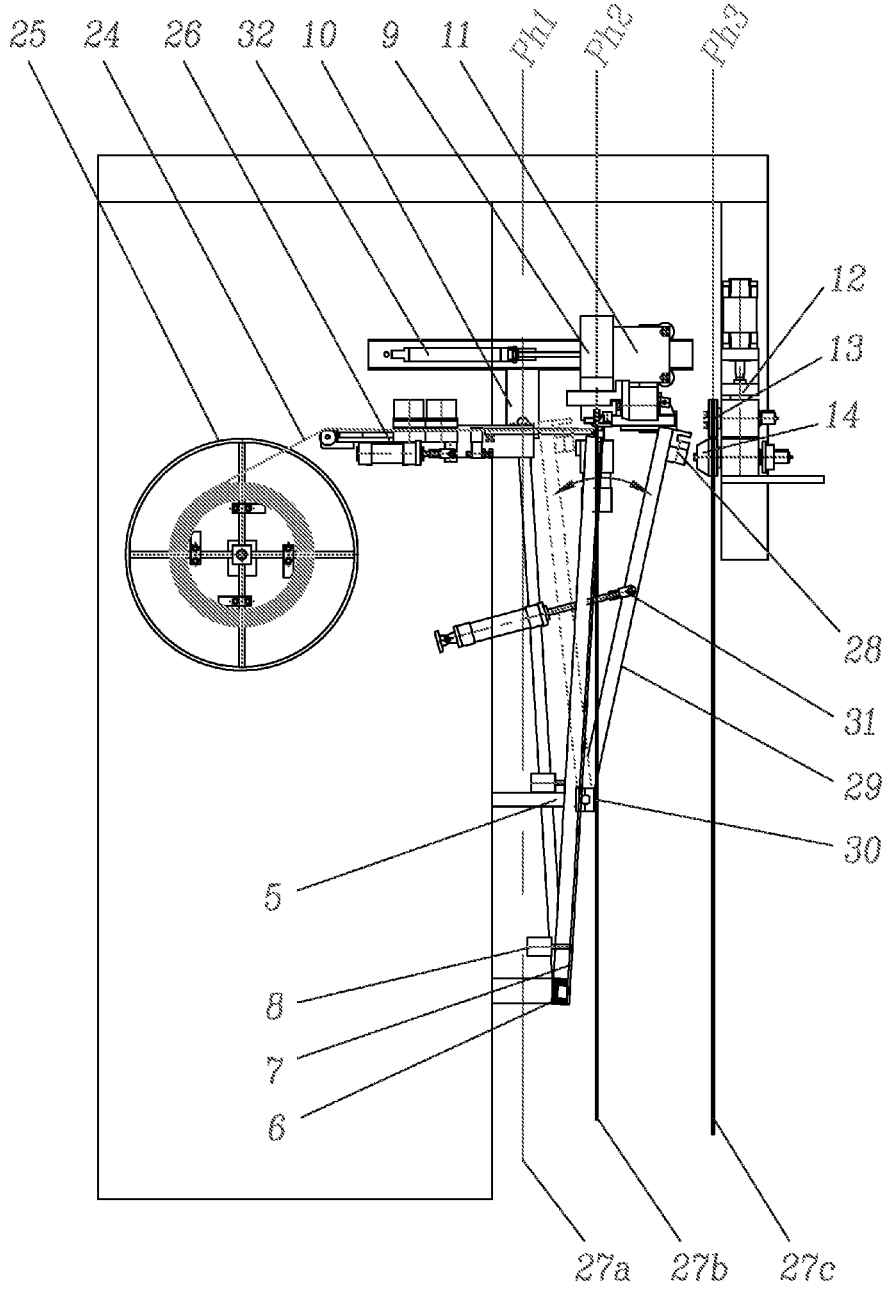
FIG. 3 depicts an example of a version of the invention for the production of metallic frames in side view.

However, considering FIGS. 1-3, in a preferred version, the material 1 is pulled from a supply and is advanced by advancement rollers 3 which are driven by an electric motor through transmission. The material 1 is advanced inside the straightener, straightening mechanism 2, where it is also straightened. The advanced length is measured by the measuring pair 4, measuring device. Notably, according to versions of processes of the present invention, when implemented, the advancement, straightening and measuring of length may be realized in any manner, such as straightening with rollers and advancement and measurement with rollers 2*a*, or with rotors with rollers 2*b* or with rotors with bushes/dies.

The material 1 is advanced through guides towards the cutter 10 and following, in guide 5 which has a circular or ellipsoid form and embodies cross section in concave form, such as the form of an angle 6. The angle of the guide 6 is covered by plates 7 which may by withdrawn by the action of cylinders 8. The diameter of the circle of guide 5, or radii of arcuate sections of guide 5, are of suitable size so that the material 1 cannot be plastically, that is permanently, deformed. As depicted in FIGS. 1-2, the end of the circular guide 5 terminates at the joining mechanism 9 at a joining station Ph2 axially offset from the feeding station Ph1.

With the filling of the guide 5 the end of material 1 is restrained by the gripper 15, the cap 7 of the circular guide 5 opens, and the advancement of the material 1 continues until there has been advanced a length of material at least equal to the expanse of the under-production frame. The material 1 hangs between the working phases Ph1 and Ph2 restrained by the gripper 15 and by the guide of cutter 10.

With the energization of the cutter 10, the material 1 is cut and the end is transferred from the region of the cutter to the joining mechanism 9 towards the gripper 16 for end of wire. In this case, it is contemplated that this transfer of the end that is transferred from feeding station at Ph1 to the joining mechanism towards the gripper 16 for end of wire is realized by a carrier 11 with gripper 34 which is moved by two cylinders 32,33.

Under the invention, the process of production occurs simultaneously at three different places/stations Ph1, Ph2, Ph3, with three respective different phases Ph1, Ph2, Ph3. That is to say, the material is advanced (and may be simultaneously straightened), its ends are connected, and its sides are bent.

Thus, according to versions of the processes and implementations of the present invention, production of the metallic frames is implemented in three phases Ph1, Ph2, Ph3. Considering the exemplary version as depicted in FIGS. 1-3, in the first phase Ph1, the wire or strip material 1 is fed. As previously explained, this feeding may be to a straightener 2 with feed rollers 3, and the length of advanced material 1 may be measured with the measuring unit 4. The material 1 is advanced initially in a circular guide 5. This circular guide 5 comprises a stationary hollow section 6, for example in the form of a "π" or arcuate or angled, which is covered by a plate which may be unitary or in sections 7, so that it may open and the material be removed from its interior.

When the advancement of the material 1 in the guide 5 is completed, its end arrives in the appropriate location at the joining mechanism 9 at a joining station located Ph2 axially offset relative to the entry point into the guide 5 at first location Ph1. The end of the material 27*a* being restrained at the joining mechanism 9 by a gripper 15, the guide 7 opens and the advancement of material continues until there is advanced material 27*a* equal to the extent of the metallic frame 27*c*, FIG. 4. This material 27*a* hangs from the place of advancement and from the place of restraint 15 on the joining mechanism 9, and assumes a curved form which does not cause permanent deformations in the material. With the completion of the advancement, in the exemplary version the material 1 is cut at the cutter 10 and the end of the cut wire from the frame side is transferred to joining unit 9 by the action of the transfer mechanism 11.

At the joining mechanism 9 there is implemented a second phase Ph2 of production of the frame, during which the two ends of the under-production metallic frame are mutually joined. Generally, this joining should be understood to be implementable with any method of joining, such as welding 40 or joining 41 with a strip 24.

Figure 5:
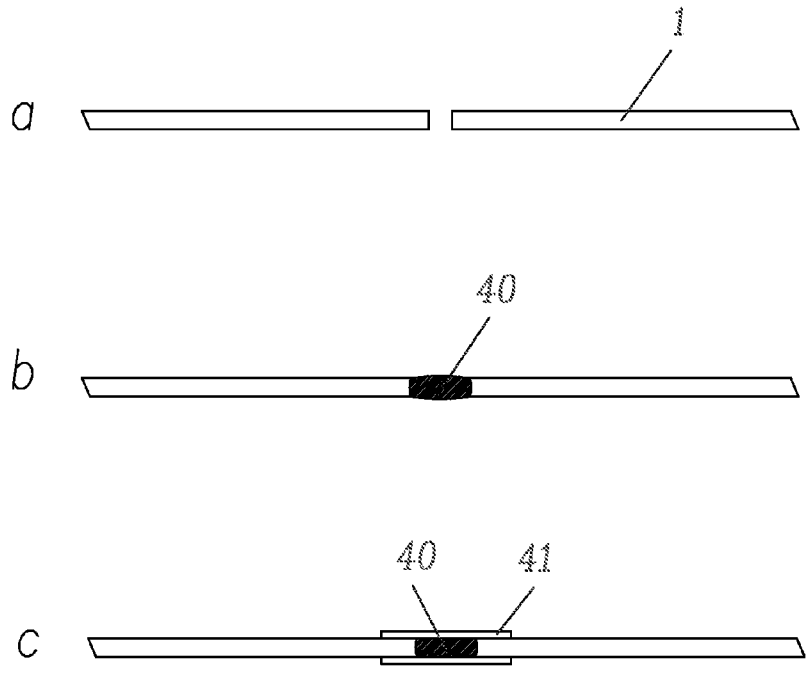
FIGS. 5*a*-5*c* depict an advantageous joining method for ends.

According to versions of processes of the present invention, the joining of the ends of the wire or strip, FIG. 5*a*, may be made with resistance welding 40, as depicted in FIG. 5*b*. Here, the quality of the weld is significant for the endurance of the joint and depends on the material of the wire or strip. Alternatively, the joining of the ends may be made with a clip with plate that encloses the ends. In the case of clip-joining it is possible to effect cuts, incisions or notches in the wire or strip so that the cover of the clip-joint 41 surrounds the joined ends with influx of material into the cuts, incisions or notches. Here, the quality of the joint depends on the proper function of the clip-joining mechanism. Further, as depicted in FIG. 5*c*, the joining of the ends may be realized with a combination of resistance welding 40 and additional clip-joining 41 in the joining region. In this case, the ends are joined by beginning with resistance welding 40 and in following, at the same region, the strip 24, FIG. 3, of the clip-joint 41 is wrapped around while the region of welding still renders high temperature. Via the clip-joining 41 the material of the frame is compressed as it is surrounded by the cover 41 wrapped around it. The combination of welding 40 and clip-joining 41 creates a very strong connection of the ends.

The connection with welding, FIG. 5*b*, endures pulling but has a weakness in bending, while the connection with strip (clip-joint), FIG. 5*c*, endures bending, but has weakness to pulling. The combination of these two types of connection eliminates the above disadvantages, while ensuring both of the advantages, providing a very strong connection. The simultaneous welding and clip-joining may be realized in frame material including wire, or strip or any other material of prismatic cross section. From the aforegoing description, it may be understood as also within the scope of some exemplary versions of the invention to set forth an advantageous process for joining together the ends of material 1 such as wire or strip or other material of prismatic cross section, including the steps of:

resistance welding the ends of the material;

heating the ends of the material as a result of the resistance welding;

characterized by:

wrapping the heated ends of the welded material with the strip of the clip while the region of welding still renders high temperature;

in the clip-joining compressing the material of the frame as it is surrounded by the cover which is wrapped around it; and, creating a very strong connection of the ends by combining the welding and the clip-joining. While different metallic materials 1 that may be joined in this fashion may vary as to their physical characteristics, it is particularly advantageous if the wrapping of the heated ends of the welded material with the strip of the clip 41 while the region of welding renders high temperature occurs in a time interval after the resistance welding while the material is still at a postwelding temperature high enough for plastic deformation.

Further considering the exemplary implementation as depicted in FIGS. 1-3, at the joining mechanism 9 the ends are resistance welded and, in following, are wrapped with strip 24 and tightly squeezed by the action of suitable tools. The joining mechanism 9 includes a welding head that welds the two ends of the frame with resistance welding. The welding head includes electrodes 17,18 in which are confined the ends of the frame 27*b*, from cylinders 19 which squeeze the electrodes. One pair of electrodes is stationary, while the second pair of electrodes is seated on lever 20 which is moved by cylinder 21. By the action of cylinder 21 the ends of the frame 27*b* are squeezed together. The welding current is transferred from the welding transformer 22 towards the welding electrodes 17,18 by the flexible conductors 23. The welding procedure is as follows: The ends are trapped in the grippers 15 and 16, the ends of the material of the frame 27*b* come into contact and are pressed to one another, and, in following, there is energized the flow of current which fluxes through the contact location and induces localized melting and welding.

With the conclusion of welding, the grippers 15,16 are deenergized and the electrodes 17,18 are withdrawn from the welding location. As more fully understandable from FIG. 3, in following, strip 24 of a suitable width is advanced to an appropriate length under this welding location. The strip 24 is stored in a supply 25 and is advanced towards the joining mechanism 9 by the advancement mechanism 26.

The strip 24 is cut and simultaneously wrapped around the frame material 27*b* by the action of suitable tools. The combination of the welding of the ends of the frame 4, FIG. 5*b*, and the wraparound, FIG. 5*c*, and tightening of the region of the ends by the strip 41, 24 brings about maximal capability for restraining the ends.

Considering the third phase Ph3, there is transfer of a frame loop 27*b* from the joining station Ph2 to the bending station Ph3, this bending station being disposed at a second axially spaced offset location Ph3. As a specific example, considering the exemplary illustrations in FIGS. 3-4, subsequently to second phase Ph2, with suitable grippers 28 the intermediate product is transferred to the bending mechanism 12, located Ph3 in offset, axially, relative to the location Ph2 of the joining unit 9, where the third phase Ph3 of frame production is implemented. The bending mechanism 12, FIG. 3, disposes a pair of roller bending tools 13, 14 and one pair of advancement rollers 37,38 that are driven by the drive 35. With appropriate advancements of material and appropriate bendings, the desired metallic frame is produced.

Figure 4:
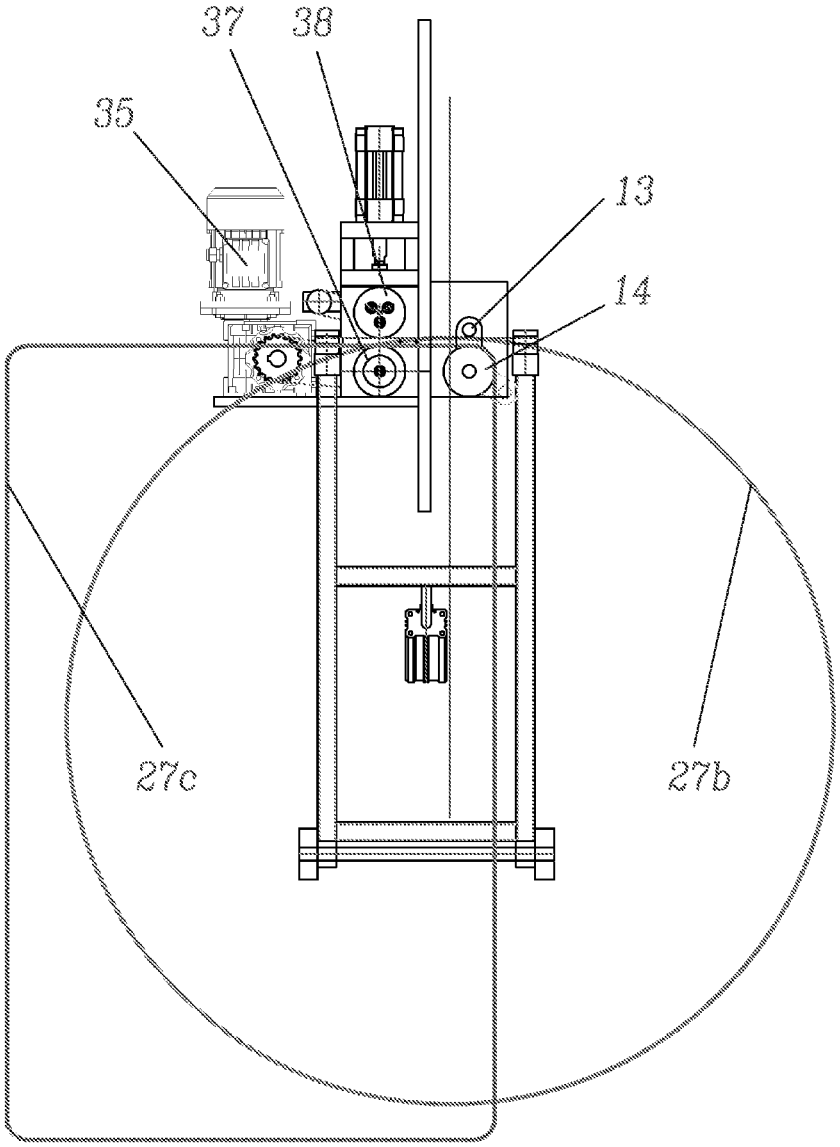
FIG. 4 depicts a bending mechanism.

In a preferred exemplary implementation depicted in FIGS. 3-4, the welded and joined frame 27*b* is transferred towards the bending mechanism 12 by the grippers 28 that are situated on lever 29 that is seated on axis 30, and which undergo movement with the lever 29 by the cylinder 31. The bending mechanism 12 comprises a pair of rollers 13, 14, with the roller 14 being a central pin and the roller 13 having a seat on the axis of the central pin and being rotatatable by the action of a motor. Thus, with the conclusion of the joining process the connected frame 27*b* is transferred to the bending mechanism 12 by the action of jaws 28, which receive it from the joining mechanism 9 and render it to the advancement rollers 37,38 of the bender 12 and to the bending rollers 13,14. The material of frame 27*c* is restrained inside the advancement rollers 37,38 set, which are moved by motor 35 through transmissions. The advancement rollers 37,38 capture the frame material 27*c* and advance it at appropriate lengths, which advancements follow appropriate bendings. The frame 27*c*, FIG. 4, is produced with sequential advancements and bendings of the welded and joined frame 27*b*. Notwithstanding the specific exemplary description, it should be readily understandable that according to the versions of the processes and implementations of the invention, there may be produced any form of metallic frame with predefined sides and corners.

According to the method of the present invention, the three phases of production of the frame, i.e., the first phase Ph1 of advancement and possible straightening of the material, the second phase Ph2 of joining of ends of the material, and the third phase Ph3 of bending of the corners of the frame may be simultaneously realized in parallel, at axially offset stations, with result the maximization of productivity.

A system may be advantageously controlled from a central computer, in which are programmed the form of the frame, its shape and dimensions, and which computer controls the motions of the mechanisms.

Generally regarding the scope of protection of the appended claims, it should be understood that the present invention is not limited in any manner to the described and drawings-depicted implementation, but may be realized in many forms and dimensions without abandoning the region of protection of the invention. Furthermore, in the implementation of the invention the materials that are used, and also as well the dimensions of the individual elements may be chosen according to the demands of a particular construction. Furthermore, in every claim, wherein elements or characteristics are referred to and are followed by reference numbers or labels, these are included solely to increase the understandability of the claims, and in this manner the reference numerals do not affect the consideration of the elements and characteristics, which are exemplarily recognizable with them.

REFERENCE LABELS LIST

1 material (wire, rod, strip, or any/prismatic cross section)
2 straightening mechanism/unit
2*a* rollers
2*b* rotors with rollers
3 advancement rollers
4 measuring rollers
5 store/guide
6 guide, stationary hollow section/angle
7 cap/plate
8 cylinders/motors
9 joining mechanism/unit
10 cutter
11 carrier/transfer mechanism
12 bending mechanism
13, 14 roller bending tools
15 gripper (place of restraint on joining mechanism)
16 gripper
17, 18 electrodes
19 cylinders
20 lever
21 cylinder
22 welding transformer
23 flexible conductors
24 strip (material)
25 strip supply
26 advancement mechanism
27 welded/joined frame
27*a* material loop, advanced material
27*b* frame loop (welded/joined)
27*c* frame/product (bent)
28 grippers/jaws
29 lever
30 axis
31 cylinder
32, 33 cylinders
34 gripper
35 drive of advancement rollers
37, 38 advancement rollers
40 resistance welding
41 clip joint/cover
Ph1 phase/location one, feeding station
Ph2 second phase/location, joining station
Ph3 third phase/location, offset location, bending station

What is claimed is:

1. A system for the production of frames from material, comprising:
a feeding station configured to introduce material sections;
a joining station configured to join together the ends of material sections introduced into the machine to produce frame loops;
a bending station configured to controllably bend frame angles in frame loops produced by said joining station;
said joining station being disposed at a first axially spaced offset location, said first axially spaced offset location being spaced from a location of said feeding station, in the direction of an axis passing through said feeding, joining, and bending stations;
a material guide extending between said feeding station and said joining station, said material guide having a channel;
a clamping mechanism configured to retain a first unjoined end of a material section passed through said material guide;
at least one release mechanism configured to controllably release material from said material guide;
transfer mechanisms configured to transfer a second unjoined end of a material section from said feeding station to said joining station and, to transfer a frame loop from said joining station to said bending station, said bending station being disposed at a second axially spaced offset location, spaced from said first offset location of said joining station in the direction of the axis passing through said feeding, joining, and bending stations.

2. A system for the production of frames from material claimed in claim 1, further comprising:
said feeding station has advancement rollers;
said feeding station has a straightener; and,
said feeding station has measuring rollers.

3. A system for the production of frames from material as claimed in claim 1, further comprising:
said joining station has a joining mechanism;
a carrier, said carrier configured to transfer a material end from said feeding station to said joining mechanism; and,
said joining station has a gripper for the material end transferred from said feeding station to said joining mechanism by said carrier.

4. A system for the production of frames from material as claimed in claim 1, further comprising:
said joining station has a welding head, said welding head having electrodes.

5. A system for the production of frames from material as claimed in claim 1, further comprising:
said bending station has a bending mechanism;
said bending mechanism including a pair of roller bending tools, and said bending mechanism including a pair of advancement rollers.

6. A system for the production of frames from material as claimed in claim 1, further comprising:
said material guide has at least one of a circular or ellipsoid form; and,
said material guide embodies a cross section of concave form.

7. A system for the production or frames from material as claimed in claim 1, further comprising:

said at least one release mechanism includes plates, said plates being withdrawable by cylinders.

8. A system for the production of frames from material as claimed in claim 1, further comprising:

said joining station has a joining mechanism;

said bending station has a bending mechanism; and, grippers configured to transfer a welded and joined frame loop from said joining mechanism to said bending mechanism, said grippers being on a lever.

9. A process for the production of frames from material, comprising the steps of:

introducing a material section via a feeding station;

guiding the material section between the feeding station and a joining sta on through a material guide;

clamping the material section when a first unjoined end of the material section is in the joining station;

releasing the material section from the material guide;

transferring a second unjoined end of the material section to the joining station;

joining together the ends of the material section at the joining station to produce a frame loop;

bending frame angles in the produced frame loop at a bending station;

disposing the joining station at a first axially spaced offset location spaced from a location of said feeding station, in the direction of an axis passing through said feeding, joining, and bending stations;

disposing the bending station at a second axially spaced offset location spaced from the first offset location of said joining station, in the direction of an axis passing through said feeding, joining, and bending stations; and, transferring a frame loop having joined ends from said joining station to said bending station.

10. A process for the production of frames from material as claimed in claim 9, further comprising the steps of:

resistance welding the ends of the material;

heating the ends of the material as a result of the resistance welding;

wrapping the heated ends of the welded material with the strip of a clip while the region of welding still renders high temperature;

in the clip-joining compressing the material of the frame as it is surrounded by a cover which is wrapped around it; and, creating a very strong connection of the ends by combining the welding and the clip-joining.

11. A process for the production of frames from material as claimed in claim 9, further comprising the step of:

releasing the material section from the material guide by withdrawing plates via motors.

12. A process for the production of frames from material as claimed in claim 9, further comprising the steps of:

transferring the second unjoined end of the material section to the joining station with a carrier; and, gripping with a gripper the second unjoined end of the material section transferred to the joining station.

13. A process for the production of frames from material as claimed in claim 9, further comprising the step of:

transferring a frame loop from the joining station to the bending station with grippers on a lever.

14. A process for the production of frames from material as claimed in claim 9, further comprising the step of:

bending frame angles in the produced frame loops at the bending on with a pair of roller bending tools and a pair of advancement rollers.

15. A system for metallic frame production comprising:

a feeding station configured to advance frame material, said feeding station being at a first location;

a joining station configured to join ends of advanced frame material, said joining station being at a second location;

a bending station configured to bend frames from joined-end frame material loops, said bending station being at a third location;

said second location being at a first axial offset from said first location in the direction of an axis passing through said feeding station, said joining station and said bending station; and, said third location being at a second axial offset from said second location in the direction of an axis passing through said feeding station, said joining station and said bending station.

16. A system for metallic frame production as claimed in claim 15, further comprising:

at least one gripper configured to transfer joined-end frame material loops from said joining station to said bending station.

17. A system for metallic frame production as claimed in claim 15, further comprising:

at least one guide between said feeding station and said joining station.

18. A process for metallic frame production comprising steps of:

passing frame material through a feeding station at a first location;

guiding a leading end of the frame material to a joining station at a second location;

securing the leading end of the frame material at the joining station;

transferring a terminal end of the frame material to the joining station;

joining the leading and terminal ends of the frame material to form a frame material loop at the joining station;

transferring the frame material loop to a bending station at a third location;

providing a first axial offset between said second location and said first location, the first axial offset being in the direction of an axis passing through the feeding station, the joining station and the bending station; and, providing a second axial offset between said third location and said second location, the second axial offset being in the direction of an axis passing through the feeding station, the joining station and the bending station.

19. A process for metallic frame production as claimed in claim 18, further comprising steps of:

welding the leading and terminal ends of the frame material; and, wrapping the heated welded ends with the strip of a dip.

20. A process for metallic frame production as claimed in claim 18, further comprising step of:

transferring the terminal end of the frame material to the joining on with a gripper on a carrier.

* * * * *

UNITED STATES PATENT AND TRADEMARK OFFICE

CERTIFICATE OF CORRECTION

PATENT NO. : 9,067,256 B2
APPLICATION NO. : 13/823712
DATED : June 30, 2015
INVENTOR(S) : Antonios Anagnostopoulos It is certified that error appears in the above-identified patent and that said Letters Patent is hereby corrected as shown below:

In the Claims:

Claim 9 at column 11, line 16, “sta on” should be changed to -- station --

Claim 14 at column 12, line 4, “on” should be changed to -- station --

Claim 19 at column 12, line 57, “dip” should be changed to -- clip --

Claim 20 at column 12, line 61, “joining on” should be changed to -- joining station --

Signed and Sealed this
Twenty-fourth Day of November, 2015

Michelle K. Lee

Michelle K. Lee
*Director of the United States Patent and Trademark Office*